United States Patent [19]

Lisiecki

[11] Patent Number: 4,588,122

[45] Date of Patent: May 13, 1986

[54] IN-FOLDED FIN SEAL END CLOSURE

[75] Inventor: Robert E. Lisiecki, Farmington Hills, Mich.

[73] Assignee: Ex-Cell-O Corporation, Troy, Mich.

[21] Appl. No.: 771,950

[22] Filed: Sep. 3, 1985

[51] Int. Cl.[4] ..... B65D 5/42

[52] U.S. Cl. ..... 229/17 R; 229/48 T; 229/DIG. 4

[58] Field of Search ..... 229/DIG. 4, 17 R, 17 G, 229/37 R, 48 T

[56] References Cited

U.S. PATENT DOCUMENTS 3,158,073 11/1964 Rumberger ..... 229/DIG. 4
3,199,763 8/1965 Anderson ..... 229/DIG. 4
3,319,868 5/1967 Huang et al. ..... 229/17 G
4,520,957 6/1985 Lisiecki ..... 229/17 R
4,546,915 10/1985 Lisiecki ..... 229/17 G

*Primary Examiner*—William Price
*Assistant Examiner*—Gary E. Elkins
*Attorney, Agent, or Firm*—John P. Moran

[57] ABSTRACT

There is disclosed a flat end closure arrangement for a thermoplastic coated paperboard container, and the blank therefor, wherein a suitable adhesive or anti-sealant is applied to four sets of four quadrant areas around intersections of score lines about which adjacent panels are folded both laterally and longitudinally in substantially 180° bends, to provide areas of slippage between selected adjacent panels, thereby diminishing the chances of cracking of the thermoplastic coating at the bend locations.

2 Claims, 9 Drawing Figures

IN-FOLDED FIN SEAL END CLOSURE

TECHNICAL FIELD

This invention relates generally to liquid-carrying, thermoplastic coated paperboard cartons and, more particularly, to a flat end closure therefor.

BACKGROUND ART

Heretofore, thermoplastic coated paperboard cartons having flat end closures of the in-folded and/or out-folded fin sealed types have been used with generally satisfactory results. When the, so-called, in-folded type of end closure is used, several panel thicknesses are operative in the folding operations. The multiple panel thicknesses, when folded and sealed, cause buckling or compression distortion of the inner layers or stretching or tensioning of the outer layers around the inner layers to the extent that the outermost thermoplastic layers may tend to pull apart and crack, thereby destroying the liquid impermeable thermoplastic layer, permitting leaking therethrough.

Three known approaches, each of which include supplemental score lines and or embossments to solve such a cracking problem, are shown in Holmstrom U.S. Pat. No. 4,267,957 and in Lisiecki patent application Ser. Nos. 634,718 and 720,314.

DISCLOSURE OF THE INVENTION

A general object of the invention is to provide an improved in-folded fin seal type of end closure for a thermoplastic coated paperboard carton, with provisions for retarding inherent characteristics tending to cause cracking of the thermoplastic coating during the forming operations.

Another object of the invention is to provide an improved in-folded fin seal type of end closure for a thermoplastic coated paperboard carton, including means for providing controlled slippages of adjacent layers for facilitating folding without causing tensioning and cracking of the outer edges of the various layers during the folding process.

A further object of the invention is to provide an in-folded fin seal type of end closure for a thermoplastic coated paperboard carton, including four sets of four anti-sealant areas at four intersections of adjacent panels, to thereby minimize stretching or tensioning at 180° bend locations and resultant cracking of the thermoplastic coating.

Still another object of the invention is to provide an in-folded fin seal type of end closure for a gable top type of thermoplastic coated paperboard carton, including four sets of four areas having a suitable anti-sealant applied thereto, such areas being located on adjacent quadrants of the outside surfaces of each inner closure panel, triangular fold-out panel, full width sealing panel, and half-width sealing panel for providing controlled slippages rather than buckling, between adjacent panels to diminish the chances for cracking of the thermoplastic coating at the bend locations.

These and other objects and advantages of the invention will be more apparent when reference is made to the following drawings and the accompanying description.

BEST MODE OF CARRYING OUT THE INVENTION

Figure 1:
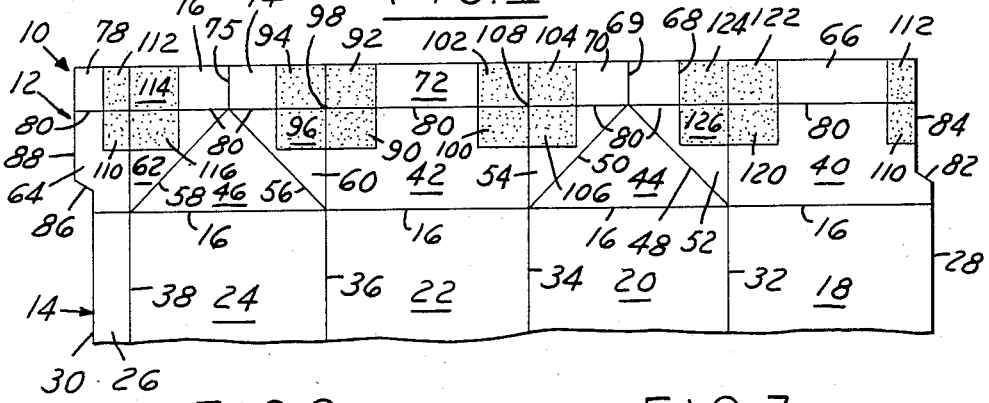
FIG. 1 is a fragmentary layout view of the outside surface of a thermoplastic coated paperboard container blank used to construct a container having an end closure to which the present invention may be adapted.

Referring now to the drawings in greater detail, FIG. 1 illustrates a fragmentary container blank 10 formed in accordance with the principles of the present invention. The container blank 10 is generally divided into three sections including a first end closure 12, a body portion 14, and a second end closure (not shown). A horizontal score line 16 extends transversely across the container blank 10 and separates the end closure 12 and the body portion 14. The body portion 14 comprises a plurality of integrally connected body panels, namely, a first panel 18, a second panel 20, a third panel 22 and a fourth panel 24, and a side seam flap or narrow fifth panel 26 formed adjacent the fourth panel 24. The container blank 10 is defined on its longitudinal sides by its free edges 28 and 30. The body panels 18, 20, 22 and 24, and the side seam flap 26, are defined by vertical score lines 32, 34, 36 and 38.

The end closure 12 has a pair of inner closure panels 40 and 42 which are integral with and extend longitudinally from the body panels 18 and 22, respectively. A pair of triangular closure panels 44 and 46 are an integral part of the end closure 12, and they extend longitudinally from the body panels 20 and 24, respectively. The triangular closure panel 44 is defined by the transverse score line 16 and diagonal score lines 48 and 50. The triangular closure panel 44 is integrally connected to the inner closure panels 40 and 42 by a pair of triangular panels 52 and 54, respectively. The triangular closure panel 46 is defined by the horizontal score line 16 and a pair of diagonal score lines 56 and 58. A pair of triangular fold-out panels 60 and 62 integrally connect the triangular closure panel 46 to the inner closure panel 42 and an extension panel 64 of the side seam flap 26, respectively. As is set forth in more detail hereinafter, the side seam flap 26 is connected to the inner closure panel 40 so as to place the triangular panel 62 adjacent the closure panel 40 in a constructed or erected container. Sealing panels 66, 68, 70, 72, 74, 76 and 78 are connected at a horizontal score line 80 extending transversely across the blank 10 to the panels 40, 52, 54, 42, 60, 62 and 64, respectively. A score line 69 separates the panels 68 and 70, and a score line 75 separates the panels 74 and 76.

The free edge 28 is terminated by an inwardly directed diagonal edge 82, with a vertical edge 84 extending from the inner end of the diagonal edge 82 and bordering the panels 40 and 66. The cutting of the edges 82 and 84 serves to form a stepped tab on the adjacent blank (not shown) like that defined by the edges 85 and 88 on the extension panel 64 of the side seam flap 26.

The details of typical second end closure arrangements are discussed in detail in U.S. Pat. Nos. 3,498,524; 3,120,335 and 4,341,340.

Figure 2:
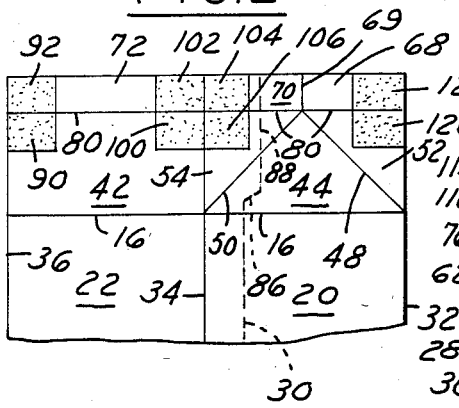
FIG. 2 is a fragmentary layout view of the outside surface of a container structure after it is side seamed from the container blank illustrated in FIG. 1.

The container blank 10 illustrated in FIG. 1 is first formed into a side seam blank as illustrated in FIG. 2. The side seam blank is formed by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the edge 28 comes into contact with the outside surface of the side seam flap 26, and the edge 28 is positioned parallel and aligned with the vertical score line 38. The various members of the first end closure 12 and the second end closure (not shown) will make similar movements, and the container will appear as illustrated in FIG. 2. The container blank 10 is then sealed where the inside area of the body panel 18 comes into contact with the outside surface of the side seam flap 26.

Figure 3:
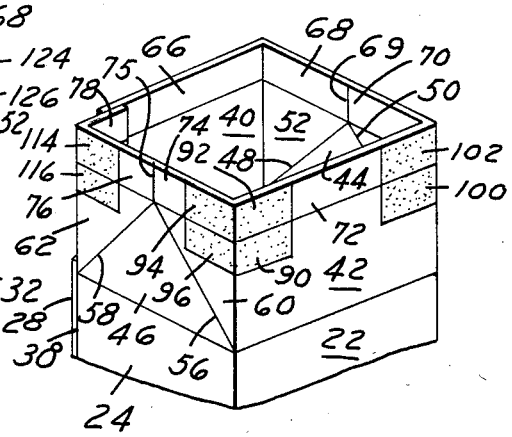
FIG. 3 is a fragmentary perspective view showing the side seamed container blank illustrated in FIG. 2 in an open ended condition prior to the closing of the end closure structure of the present invention.

The next step in forming the side seamed blank into a container is illustrated in FIG. 3. FIG. 3 illustrates how the side seam blank is opened up into a squared condition, after which the second end closure (not shown) is formed and sealed in a manner well known in the container art, and disclosed in detail in the above cited prior art patents.

After the second end closure (not shown) is formed and a product, such as milk or juice, has been inserted in the container, the various parts of the first end closure 12 are folded about the various score lines in the following manner so as to form the closed end structure. The triangular panel 44 is moved around the horizontal score line 16 over the end of the filled container and away from its center. At the same time, the triangular closure panel 46 is likewise moved away from the center of the filled container about the horizontal score line 16. The inside surfaces of the sealing panels 68 and 70 are rotated towards each other about the vertical score line 69, the inside surfaces of the sealing panels 74 and 76 are rotated towards each other about the vertical score line 75, and the inside surfaces of the sealing panels 66 and 72 are moved toward each other. The inside surfaces of the triangular panels 52 and 54 thereby come into contact with the triangular panel 44, and the inside surfaces of the triangular panels 60 and 62 come into contact with the panel 46.

The sealing of the panels 70, 72 and 74 to the panels 68, 66 and 76, respectively, is accomplished by conventional means, such as a sonic or high frequency vibration sealing means, such a seal providing a liquid tight seal. The sealing of these various top end closure elements may also be accomplished by other means, such as gas heat, if desired.

Figure 4:
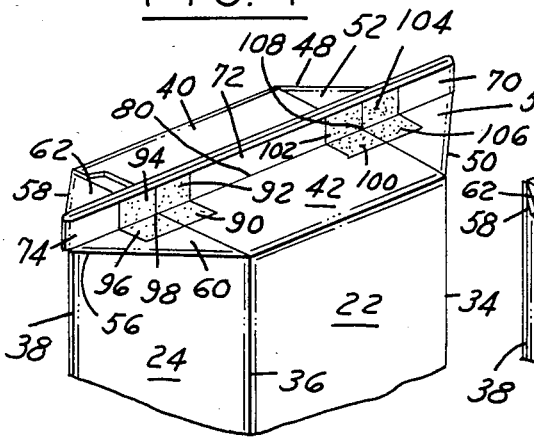
FIGS. 4 and 5 are fragmentary perspective views similar to FIG. 3, and showing the end closure evolved from the blank of FIG. 3 in partially closed conditions and embodying the inventive concept.

FIG. 4 illustrates the positions of the various elements of the top end closure 12 once the sealing thereof has been effected and the top closure has been moved into a flat configuration with the 44 and 46 groups of panels extending outwardly from the side panels 20 and 24, respectively. An abhesive or anti-sealant material, such as polysiloxane gum, is applied to four areas 90, 92, 94 and 96 adjacent the intersection 98 of the score lines 36 and 80 on the panels 42, 60, 72 and 74, respectively, and to the four areas 100, 102, 104 and 106 adjacent the intersection 108 of the score lines 34 and 80 on the panels 42, 54, 70 and 72, respectively, as shown in FIG. 4. Specifically, the height of each area is the same as the height of the panels 70, 72 and 74, and the width of each area equal to approximately half the width of the panels 70 and 74.

Figure 5:
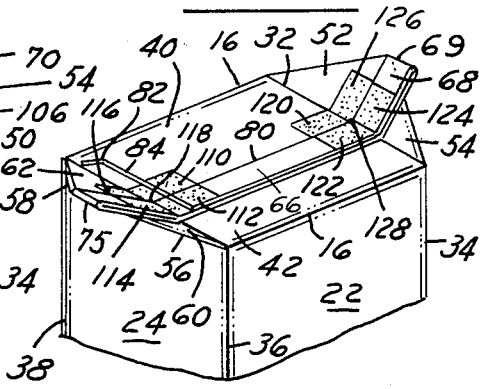

Similarly, an abhesive or anti-sealant is applied to four outside areas directly opposite the two sets of four areas 90/92/94/96 and 98/100/102/104 shown in FIG. 4. As shown in FIG. 5, the corresponding areas are 110/112/114/116 adjacent an intersection 118 of the score lines 38 and 80 on the panels 40/64, 66/78, 76 and 62, respectively, and 120/122/124/126 adjacent in intersection 128 of the score lines 32 and 80 on the panels 40, 66, 68 and 52, respectively.

Figure 6:
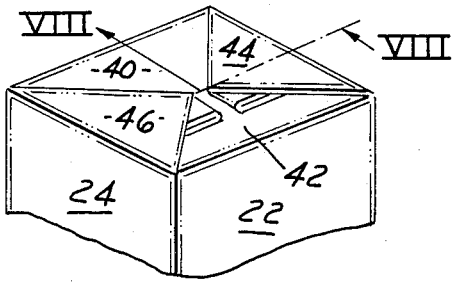
FIG. 6 is a fragmentary perspective view showing the container after the end closure embodying the invention has been folded and sealed into a flat, completely closed condition.

As also shown in FIG. 5, the 44 and 46 triangular groups of panels are both folded inwardly with a 180° turn about their respective segments of score lines 32/34 and 36/38, and the adjacent score line 16, into the flat configuration of FIG. 6 such that the panels 52/68 and 62/76 overlie the panels 40/66. In so doing, the abhesive areas 124/126 overlie the areas 122/120, and the abhesive areas 114/116 overlie the areas 112/110. It should be noted that, in view of the cut-out 82/84 on the panels 40 and 66, the areas 110 and 112 are divided between the overlapped panels 40/64 and 66/78.

Figure 7:
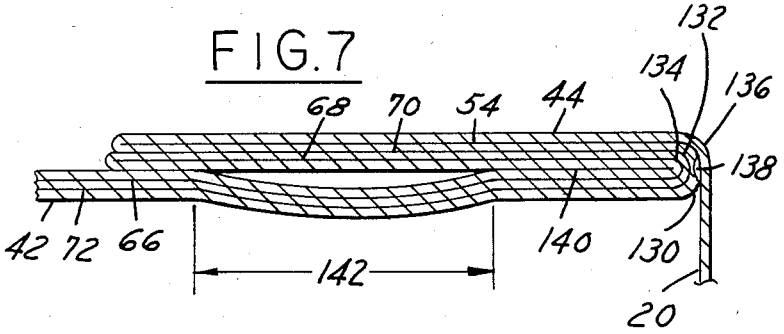
FIG. 7 is a fragmentary cross-sectional view showing a prior art container after being folded through the steps of FIGS. 4, 5 and 6.
Figure 8:
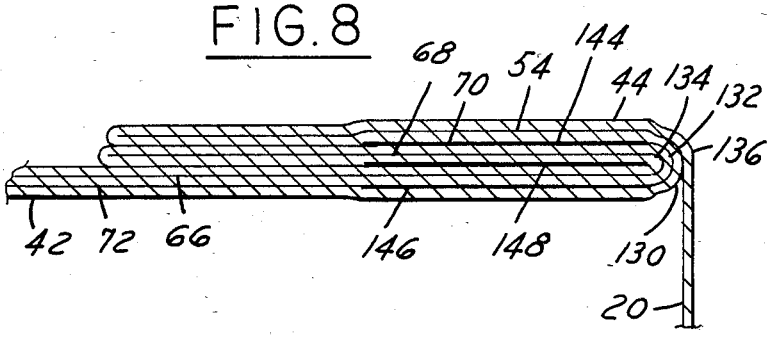
FIG. 8 is a fragmentary cross-sectional view taken along the plane of the line 8—8 of FIG. 6, and looking in the direction of the arrows, showing a container of the present invention after being folded through the steps of FIGS. 4, 5 and 6.

Without the inclusion of the anti-sealant areas 90/92/94/96; 100/102/104/106; 110/112/114/116; and 120/122/124/126, the final folded configuration of FIG. 6 would include the seven thicknesses shown in FIG. 7, wherein three layers identified as 130 (including the panels 42 and 54), 132 (including the panels 72 and 70), and 134 (including the panels 66 and 68) each will have been folded 180° and one layer 136 (including the panels 20 and 44) will have been folded 90°. Throughout such folding operations, at times the outermost 180° folded layer 130 is stretched to the point where it becomes pulled apart at the score line 34, resulting in a crack, as shown at 138 in FIG. 7. In this arrangement, the tacked or non-slipping area, represented at 140, results in a buckling or compression distortion in the area represented at 142, causing the tension crack 138. Now, by including the four sets of anti-sealant areas, the stress on the bends for the layers 130, 132 and 134 is reduced substantially by virtue of the slip coating areas, represented at 144, 146 and 148, permitting tension and compression loads to cancel out, eliminating distortion and cracking of laminate, as shown in FIG. 8.

Figure 9:
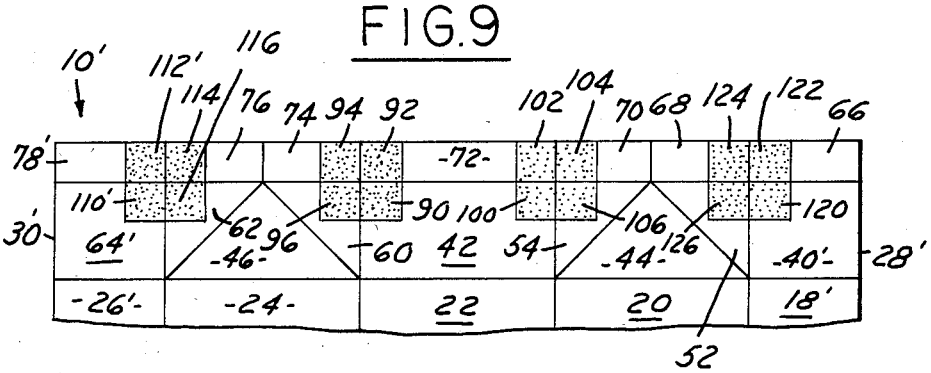
FIG. 9 is a fragmentary layout view of the outside surface of an alternate embodiment of a thermoplastic coated paperboard container blank formed in accordance with the invention.

Referring now to FIG. 9, an alternate blank embodiment 10' is shown, adaptable to being folded into a so-called, center side seam type of end closure. Those elements which differ from the respective elements of FIG. 1 are identified by reference numerals bearing primes; otherwise the elements are the same as those of FIG. 1.

Specifically, rather than a substantially full width panel segment 40 and a narrow side seam extension 64, the blank 10' includes two closure panels 40' and 64' and respective associated sealing panels 66' and 78', terminated by straight edges 28' and 30'. The associated body panels 18' and 26' are the same widths as the respective closure panels 40' and 64'. Note that anti-sealant areas 110' and 112' are located in their entireties on the panels 64' and 78', respectively, since the panels 40' and 66' are narrower than the panels 40 and 66 of FIG. 1.

While the folding process is the same as for the blank 10, once folded, the free edge 28' will be located at approximately the center of one of the sides of the resultant container, rather than at a corner, as in the case of the free edge 28 overlying the score line 38 shown in FIG. 3. The resultant slip coating areas 144,146 and 148 would be the same as that shown in FIG. 8.

INDUSTRIAL APPLICABILITY

It should be apparent that the end closures formed from either the blank 10 or the blank 10' may be used for either a top or a bottom end closure, and that stretching and possible cracking resulting form 180° bends (FIG. 7) is minimized by the inclusion of four sets of suitable abhesive or anti-sealant applied to strategic locations on the end closure panels.

It should also be apparent that the panels may be of widths such that the formed carton may be either rectangular or square in cross-section.

While but one general embodiment has been shown and described, other modifications thereof are possible within the scope of the following claims.

The embodiments of the invention in which an exclusive property or privilege is claimed are defined as follows:

1. In a blank for constructing a container adaptable to being folded into a flat end container, wherein the blank includes five body portion panels interconnected by longitudinal score lines, five end closure panels connected via a first row of lateral score lines to respective ends of the body portion panels and separated by said longitudinal score lines; said five end closure panels including two panels having triangular closure panels respectively connected to the ends of two alternate body portion panels, and inner closure panels respectively connected to the ends of the other three alternate body portion panels; a pair of triangular fold-out panels connected via diagonal score lines to the opposite sides of each of said triangular closure panels; full width sealing panels respectively connected via a second row of lateral score lines to said inner closure panels; and a pair of half-width sealing panels respectively connected via said second row of lateral score lines to each pair of triangular fold-out panels; the improvement comprising four sets of four areas having a suitable anti-sealant applied thereto, said areas being located on adjacent quadrants of the outside surfaces of each inner closure panel, triangular fold-out panel, full width sealing panel, and half-width sealing panel for providing controlled slippages between adjacent panels to eliminate buckling and consequent cracking at 180° bend locations.

2. In a flat end container including four body panels interconnected by vertical score lines, one of the body panels being formed by two partially overlapped and sealed panels, four end closure panels connected via a first row of horizontal score lines to respective ends of the body panels and separated by said vertical score lines; said end closure panels including triangular closure panels respectively connected to the top ends of two alternate body panels, a pair of inner closure panels respectively connected to the top ends of the other two alternate body panels; a pair of triangular fold-out panels connected via diagonal score lines to the opposite sides of each of said triangular closure panels; a pair of full width sealing panels respectively connected via a second row of horizontal score lines to said inner closure panels; and a pair of half-width sealing panels respectively connected via said second row of horizontal score lines to the triangular fold-out panels; the improvement comprising four sets of four areas having a suitable anti-sealant applied thereto, said areas being located on adjacent quadrants of the outside surfaces of each inner closure panel, triangular fold-out panel, full width sealing panel, and half-width sealing panel for providing controlled slippages between adjacent panels to eliminate buckling and consequent cracking at 180° bend locations.

* * * * *